US005429297A

United States Patent [19]

Walsh

[11] Patent Number: 5,429,297

[45] Date of Patent: Jul. 4, 1995

[54] POUR SPOUT FOR A CARTON

[75] Inventor: Joseph C. Walsh, Longmont, Colo.

[73] Assignee: Graphic Packaging Corporation, Paoli, Pa.

[21] Appl. No.: 184,958

[22] Filed: Jan. 21, 1994

[51] Int. Cl.[6] ..... B65D 5/70

[52] U.S. Cl. ..... 229/215; 229/220

[58] Field of Search ..... 229/125.12, 214, 215, 229/217, 219, 220

[56] References Cited

U.S. PATENT DOCUMENTS

| | | | |
|---|---|---|---|
| 1,874,318 | 8/1932 | Levkoff | 229/220 |
| 1,998,862 | 4/1935 | Caruso et al. | 229/220 |
| 2,899,119 | 8/1959 | Stowitts et al. | 229/220 |
| 3,033,436 | 5/1962 | Peimer | 229/220 |
| 3,040,953 | 6/1962 | Tindall | 229/220 |
| 3,184,137 | 5/1965 | Mohler | 229/215 |
| 3,362,612 | 1/1968 | Mohler | 229/215 |
| 4,194,677 | 3/1980 | Wysocki . | |
| 4,197,985 | 4/1980 | Austin | 229/220 |
| 5,044,503 | 9/1991 | Wein | 229/215 |
| 5,184,770 | 2/1993 | Cote | 229/125.12 |

FOREIGN PATENT DOCUMENTS

| | | | |
|---|---|---|---|
| 334433 | 9/1930 | United Kingdom | 229/125.12 |
| 916581 | 1/1963 | United Kingdom | 229/220 |

*Primary Examiner*—Gary E. Elkins

*Attorney, Agent, or Firm*—Klaas, Law, O'Meara & Malkin

[57] ABSTRACT

A pour spout for a recyclable carton is provided wherein an inner portion of the pour spout is formed from normally waste material and wherein the inner portion is removably attached to a top panel so that when the top panel is moved around its fold line the inner portion is superposed over an outer portion of the pour spout located in a sidewall panel so that when the top panel is unfolded, the inner portion breaks away to remain secured to the outer portion. In one embodiment, a pair of spaced apart side panels are integral with the inner portion to provide sidewalls for the pour spout. In another embodiment, a slide member moves with an intermediate panel in linear directions between locations to allow an opening to be used or to cover the opening.

14 Claims, 5 Drawing Sheets

POUR SPOUT FOR A CARTON

FIELD OF THE INVENTION

This invention relates generally to cartons made from paperboard or other similar materials and more particularly to providing a pour spout or opening for such cartons.

BACKGROUND OF THE INVENTION

In U.S. Pat. No. 4,194,677, there is disclosed a carton blank for forming a carton having a pour spout made form the same material. In one embodiment of the patent, a portion of the pour spout is in one of the sidewall panels. Another portion of the pour spout is in an enlarged portion of the glue panel. When the glue panel is folded over the sidewall panel, the another portion is superposed over and secured to the portion in the sidewall panel. Wing members extend outwardly from the another portion and function to form spaced sidewalls for the pour spout. One disadvantage of the pour spout in the '677 patent is that additional material is required to provide for the another portion of the pour spout. While the additional material appears to be small, the amount becomes significant when millions of cartons are manufactured. Another disadvantage is the small glue space adjacent to the extremities of the wings which may result in no seal at such areas.

BRIEF DESCRIPTION OF THE INVENTION

This invention provides a pour spout for a carton with a portion of the pour spout comprising waste material that is usually cut away in the formation of the carton blank. The carton blank is formed from a composite material, a coated paperboard or any other material having similar characteristics.

In a preferred embodiment of the invention, the carton blank comprises a unitary sheet of material having an inner surface and an outer surface. The unitary sheet of material has a left side edge, a right side edge, a top edge and a bottom edge, with the left and right side edges being perpendicular to the top and bottom edges. The unitary sheet of material has a plurality of cut and fold lines for dividing the unitary sheet of material into front and back wall panels, opposite sidewall panels, a glue panel and top and bottom wall panels extending outwardly from the front and back wall panels, and the opposite sidewall panels and joined thereto by fold lines. One of opposite sidewall panels has a series of perforated lines so that an opening can be formed therein and an outer pour spout portion is located within the perforations and has a portion thereof integral with one of the opposite sidewall panels and joined thereto by a fold line. An inner pour spout portion is joined to one of the top wall panels by a perforated line so that the one of the top wall panels may be folded around its fold line so that the inner pour spout portion may be superposed over and secured to the outer pour spout portion and the one of said top panel portions may be returned to its original position with the inner pour spout portion remaining secured to the outer pour spout portion. The inner pour spout portion is not greater in size than the outer pour spout portion in any direction. A pair of spaced apart side panels are integral with the inner pour spout portion and are joined thereto by fold lines. The one of the opposite sidewall panels has a second series of perforations so that a second opening may be formed therein. A tab is located within the second series of perforations and has a portion thereof integral with the first sidewall panel and joined thereto by a fold line. The remaining portions of the tab are separated from the outer pour spout portion by a cut line so that an inwardly directed force may be applied to the tab to move the tab inwardly so that an outwardly directed force may be applied to the outer and inner pour spout portions to move the outer and inner pour spout portions outwardly and to move the side panels outwardly to form a pour spout. A projection on each of the side panels functions to limit the outward movement of the pour spout.

In another preferred embodiment of the invention, the inner pour spout portion has a configuration slightly larger than the configuration of the outer pour spout portion so as to have an interference fit in the opening in one of the opposite sidewall panels. Also, a pair of spaced apart tabs are integral with the inner pour spout portion and are joined thereto by fold lines so that, when an outwardly directed force is applied to the inner and outer pour spout portions to move the inner and outer pour spout portions outwardly, the tabs will move outwardly and fold around the fold lines to pass through the opening and when a force is applied to move the inner and outer pour spout portions inwardly, the tabs will abut against portions of the one of the opposite sidewall panels to limit the inward movement of the inner and outer pour spout portions.

A carton is formed from the carton blank by folding one of the top wall panels around its fold line so that the inner pour spout portion moves with the one of the top wall panels until the inner pour spout portion is superposed over the outer pour spout portion; securing the inner pour spout portion to the outer pour spout portion; unfolding the one of the top wall panels to break the perforated line between the inner pour spout portion and the one of the top wall panels to return the one of the top wall panels and to leave the inner pour spout portion secured to the outer pour spout portion; folding the opposite sidewall panels and the front and back wall panels around the fold lines and securing them together using the glue panel; folding the bottom wall panels around the fold lines and securing them together to form an open ended carton that can be filled with desired ingredients, and folding the top wall panels around the fold lines and securing them together to form a filled closed carton.

In another embodiment of the invention, the pour spout means for the carton comprise an inner panel having an opening formed therein and an outer panel having a series of perforations formed therein. A slide member is located within the series of perforations so that, when the perforations are broken, the slide member can be moved between locations to expose or cover the opening. An intermediate panel having a width greater than the width of the slide member is secured to a portion of the slide member for movement therewith.

In another embodiment of the invention, the pour spout means for the carton comprise an inner panel having a series of perforations for forming an opening therein. An outer panel having a first series of perforations for forming an opening therein wherein the first series of perforations are in superposed relationship with the series of perforations in the inner panel and a second series of perforations. A slide member is located within the second series of perforations so that, when the perforations have been broken, the slide member can be moved between locations to expose or cover the openings. An intermediate panel having a width greater than the width of the slide member is secured to a portion of the slide member and functions to expose or cover the openings.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
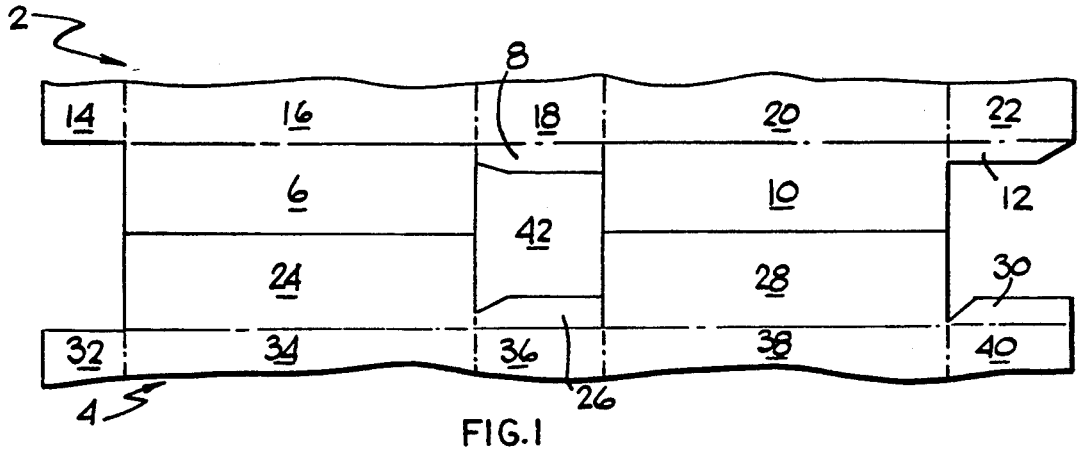
FIG.1 (PRIOR ART)
FIG. 1 is a top plan view of portions of successive carton blanks of the prior art.

In FIG. 1, there is illustrated the portions of successive prior art carton blanks 2 and 4. The carton blank 2 has a plurality of bottom wall panels 6, 8, 10 and 12, a glue panel 14, a front wall panel 16, a sidewall panel 18, a back wall panel 20 and a sidewall panel 22. The carton blank 4 has a plurality of top wall panels 24, 26, 28 and 30, a glue panel 32, a front wall panel 34, a sidewall panel 36, a back wall panel 38 and a sidewall panel 40. An empty space 42 is located between the top panels 6, 8, 10, 24 and 26 and is a result of cutting away waste material to form the bottom wall panel 8 and the top wall panel 26 in a desired configuration.

Figure 2:
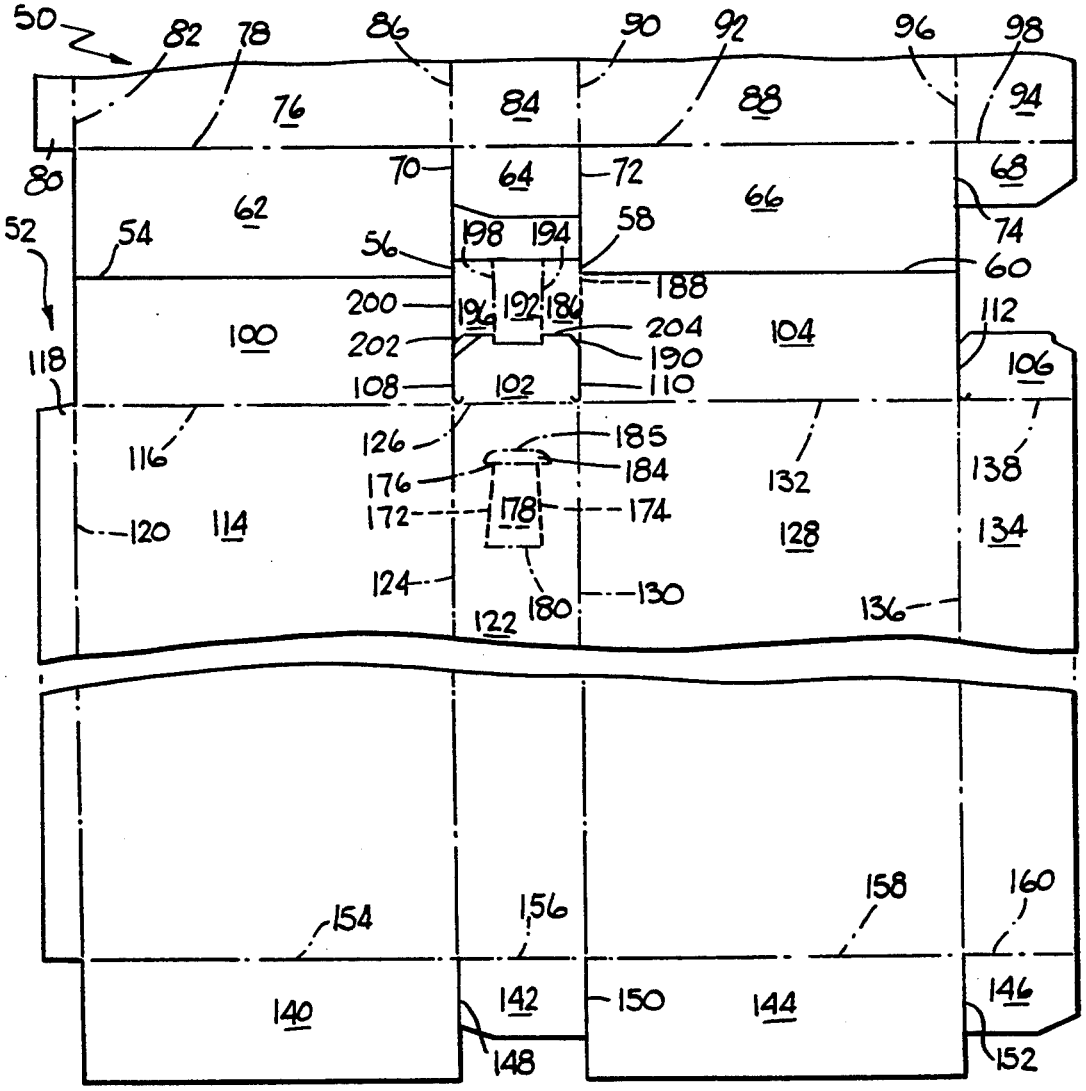
FIG. 2 is a top plan view of a preferred embodiment of a carton blank of this invention and a portion of the preceding carton blank.

In FIG. 2, there is illustrated the bottom portion of a preceding carton blank 50 and a carton blank 52 of this invention. The carton blank 50 is separated from carton blank 52 by cut lines 54, 56, 58 and 60. The carton blank 50 has bottom wall panels 62, 64, 66 and 68 separated by cut lines 70, 72 and 74. The bottom wall panel 62 is integral with a front wall panel 76 and is joined thereto by a fold line 78. A glue panel 80 is integral with the front wall panel 76 and is joined thereto by a fold line 82. A sidewall panel 84 is integral with the front wall panel 76 and is joined thereto by a fold line 86. A back wall panel 88 is integral with the sidewall panel 84 and is joined thereto by a fold line 90 and is integral with the bottom wall panel 66 and is joined thereto by a fold line 92. A sidewall panel 94 is integral with the back wall panel 88 and is joined thereto by a fold line 96 and is integral with the top panel 68 and is joined thereto by a fold line 98.

The carton blank 52 has top wall panels 100, 102, 104 and 106 separated by cut lines 108, 110 and 112. A front wall panel 114 is integral with the top wall panel 100 and is joined thereto by a fold line 116. A glue panel 118 is integral with the front wall panel 114 and is joined thereto by a fold line 120. A sidewall panel 122 is integral with the front wall panel 114 and is joined thereto by a fold line 124 and is integral with the top panel 102 and is joined thereto by a fold line 126. A back wall panel 128 is integral with the sidewall panel 122 and is joined thereto by the fold line 130 and is integral with the top panel 104 and is joined thereto by a fold line 132. A sidewall panel 134 is integral with the back wall panel 128 and is joined thereto by a fold line 136 and is integral with the top panel 106 and is joined thereto by the fold line 138. Bottom wall panels 140, 142, 144 and 146 are separated by cut lines 148, 150 and 152. The bottom wall panel 140 is integral with the front wall panel 114 and is joined thereto by the fold line 154. The bottom wall panel 142 is integral with the sidewall panel 122 and is joined thereto by the fold line 156. The bottom wall panel 144 is integral with the back wall panel 128 and is joined thereto by the fold line 158. The bottom wall panel 146 is integral with the sidewall panel 134 and is joined thereto by the fold line 160.

A first opening 170 (FIG. 5) is formed by the perforated lines 172 and 174 (FIG. 2) and a portion of the perforated line 176. An outer pour spout portion 178 fills the first opening 170; is integral with the sidewall panel 122 and is joined thereto by the fold line 180. A second opening 182 (FIG. 5) is formed by the perforated line 176. A tab 184 fills the second opening 182; is integral with the sidewall panel 122 and is joined thereto by a fold line 185.

A side panel 186 (FIG. 3) is integral with the top panel 104 and is joined thereto by the perforated line 188. A projection 190 extends outwardly from the side panel 186. An inner pour spout portion 192 is integral with the side panel 186 and is joined thereto by the fold line 194. A side panel 196 is integral with the inner pour spout portion 192 and is joined thereto by the fold line 198. The side panel 196 is separated from the top panel 100 by the cut line 200 (FIG. 2). A projection 202 extends outwardly from the side panel 196. The side panels 186 and 196 and the inner pour spout portion 192 are separated from the top panel 102 by a cut line 204. If desired, the inner pour spout portion may be secured to the top panel 102 by a perforated line. If this is done, the perforated line 188 is a cut line.

Figure 3:
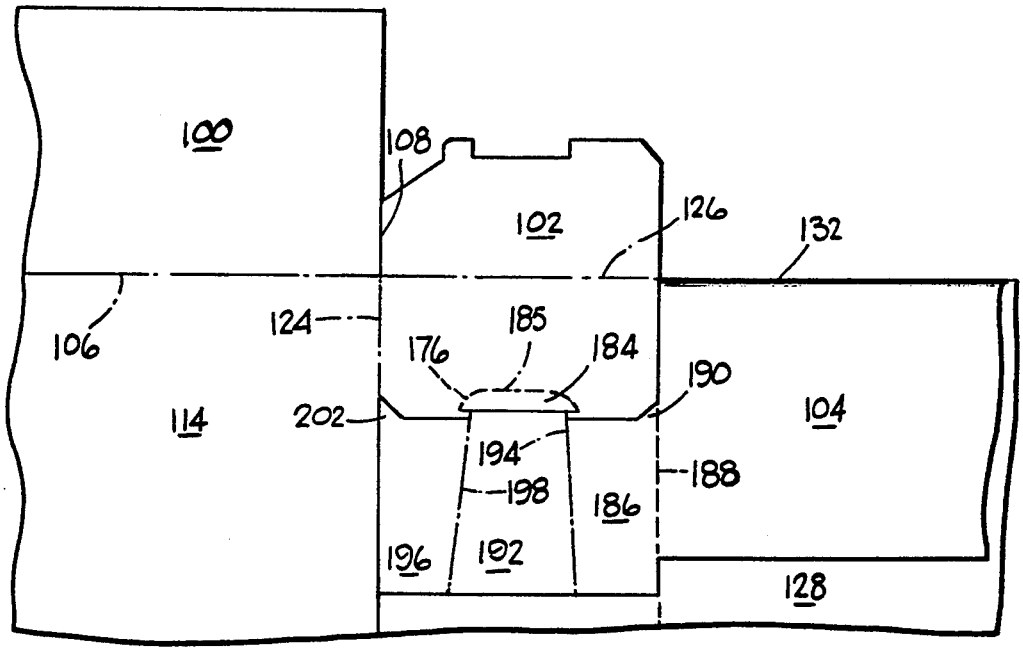
FIG. 3 is an enlarged top plan view of a portion of FIG. 2 after one folding operation.
Figure 4:
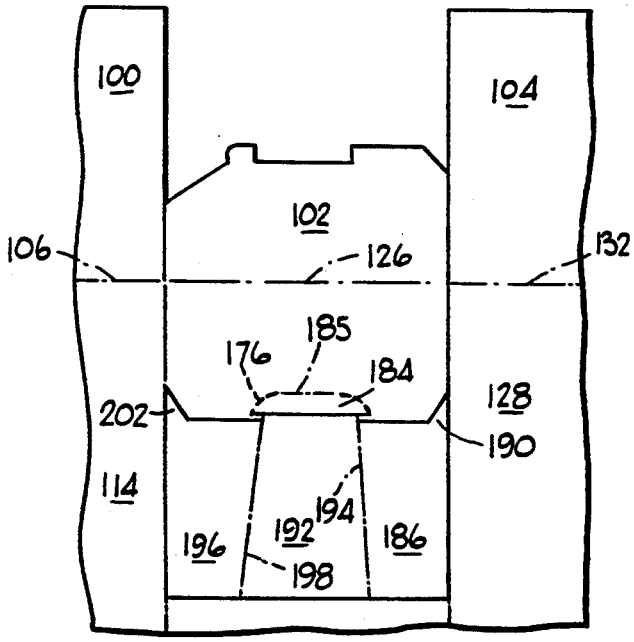
FIG. 4 is an enlarged top plan view of a portion of FIG. 2 after a second folding operation.
Figure 5:
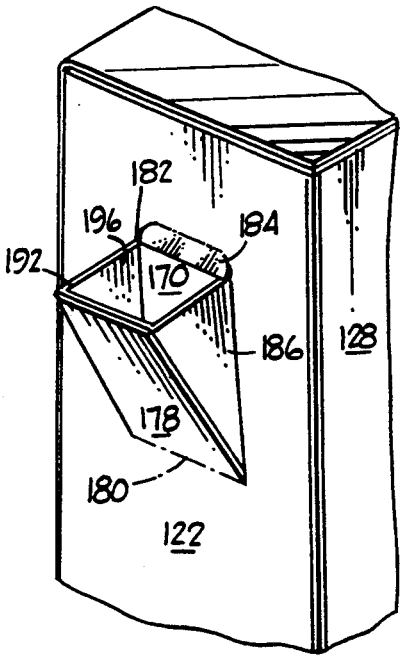
FIG. 5 is a perspective view of a portion of the carton formed from the carton blank of FIG. 2 with the pour spout opened.

The use of the carton blank 52 is illustrated in FIGS. 3–5. The apparatus used to perform the folding and filling operations is not part of this invention and will not be described. The top panel 104 is folded around the fold line 132. The side panels 186 and 196 and the inner pour spout portion 192 move with the top panel 104 since they are joined thereto by the perforated line 188. Prior to or during the movement of the top panel 104, a suitable adhesive is applied to either the outer pour spout portion 178 or the inner pour spout portion 192. As illustrated in FIG. 3, the movement of the top panel 104 is continued until the inner pour spout portion 192 is superposed over and in contact with the outer pour spout portion 178. When the adhesive has secured the outer and inner pour spout portions 178 and 192 together, the top panel 104 is folded back over the fold line 132. A conventional stop (not shown) will prevent movement of the side panel 186 so that the movement of the top panel 104 will break the perforations in the perforated line 188 to separated the side panel 186 from the top panel 104 as illustrated in FIG. 4. The inner pour spout portion 192 has a length, from top to bottom in FIG. 4, that is greater than the length of the side panels 186 and 196. The inner pour spout portion 192 preferably has a configuration substantially the same as the configuration of the superposed portion of the outer pour spout portion 178 but if desired, the inner pour spout portion 192 may be smaller than the outer pour spout portion 178. The front wall panel 114, the sidewall panels 122 and 124, the back wall panel 128 and the flue panel 118 are folded around the fold lines 120, 124, 130 and 136 and the glue panel 118 is secured to the sidewall panel 134. The bottom wall panels 140, 142, 144 and 146 are folded around the fold lines 154, 156, 158 and 160 and secured together. The open ended carton is then filled with the desired material. The top panels 100, 102, 104 and 106 are folded around the fold lines 116, 126, 132 and 138 and secured together to form a closed filled carton.

When it is desired to remove some of the material in the carton, a force is applied to the tab 184 to break the perforations in the perforated line 176 and fold the tab inwardly around the fold line 185. An outwardly directed force is applied to the outer and inner pour spout portions 178 and 192 to break the perforations in the perforated lines 172 and 174 and fold the outer and inner pour spout portions 178 and 192 around the fold line 180 as illustrated in FIG. 5. As the outer and inner pour spout portions 178 and 192 move outwardly, the side panels 186 and 196 are folded around the fold lines 194 and 198. The projections 190 and 202 contact the tab 184 and fold it outwardly around the fold line 185 until they contact portions of the sidewall panel 122 to stop the outward movement of the outer and inner pour spout portions 178 and 192. At that location, the tab 184 has returned to its original location. After the desired quantity of material has been removed, an inward directed force is applied to the outer and inner pour spout portions 178 and 192 to move them around the fold line 180 until they have returned to their original location. The contact between the facing portions of the broken perforated lines 172, 174 and 176 will provide sufficient force to retain the outer and inner pour spout portions 178 and 192 and the tab 184 in their original locations.

Figure 6:
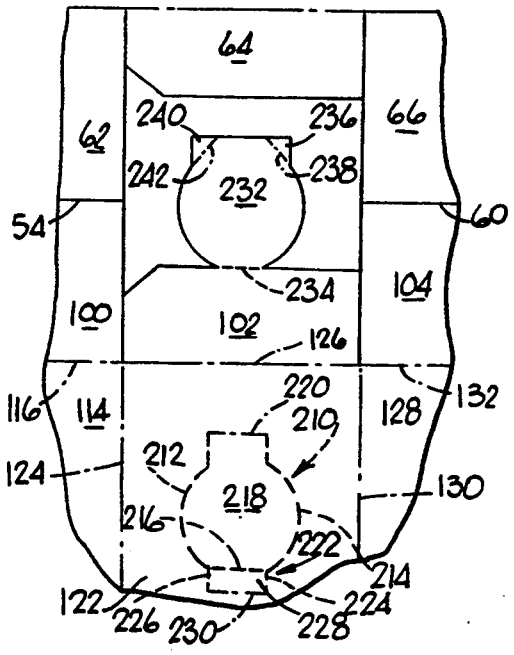
FIG. 6 is a top plan view of a portion of another preferred embodiment of a carton blank of this invention and a portion of a preceding carton blank.
Figure 7:
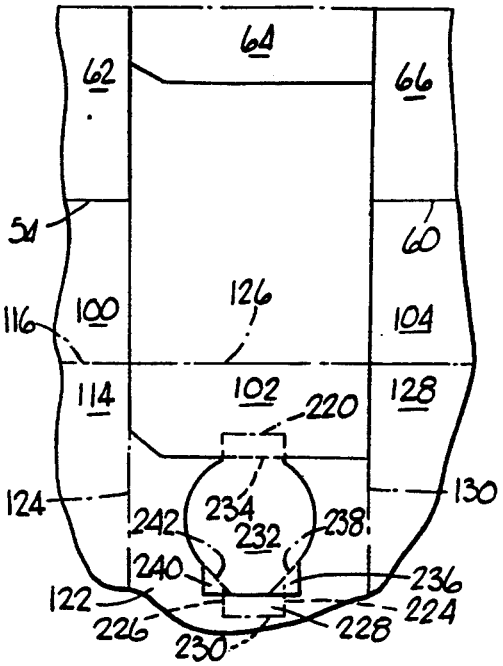
FIG. 7 is a top plan view of FIG. 6 after one folding operation.
Figure 8:
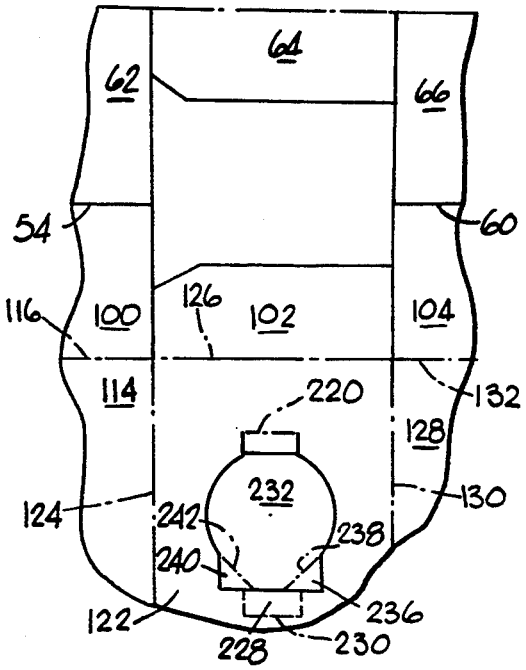
FIG. 8 is a top plan view of FIG. 6 after a second folding operation.
Figure 9:
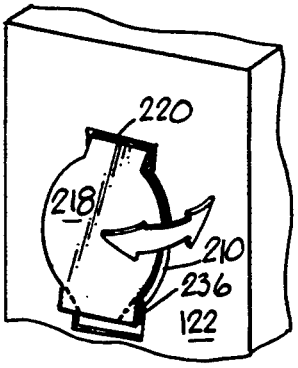
FIG. 9 is a perspective view of a portion of a carton formed from the carton blank of FIG. 6 in a partially opened position.
Figure 10:
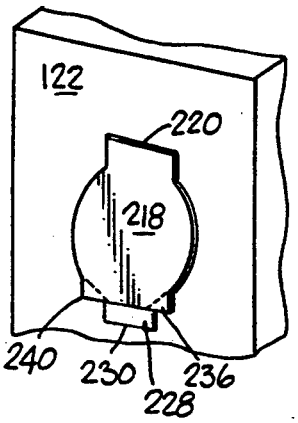
FIG. 10 is a perspective view similar to FIG. 9 in a closed position.

Another preferred embodiment of the invention is illustrated in FIGS. 6–8. The portions of FIGS. 6–8 that correspond to portions of FIGS. 2–4 have been given the same reference numerals.

A first opening 210 is defined by the perforated lines 212 and 214 and perforated line 216. An outer pour spout portion 218 fills the first opening 210, is integral with the sidewall panel 122 and is joined thereto by a fold line 220. A second opening 222 is defined by the perforated line 216 and perforated lines 224 and 226. A tab 228 fills the second opening 222, is integral with the sidewall panel 122 and is joined thereto by a fold line 230.

An inner pour spout portion 232 is integral with the top panel 102 and is joined thereto by a perforated line 234. A tab 236 is integral with the inner pour spout portion 232 and is joined thereto by a fold line 238. A tab 240 is integral with the inner pour spout portion 232 and is joined thereto by the fold line 242.

The use of the carton blank of FIGS. 6–8 is substantially the same as that described above in relation to FIGS. 2–4. The top panel 102 is moved around the fold line 126. Since the inner pour spout portion 232 is joined to the top panel 102 by the perforated line 234, it moves with the top panel 102. Prior to or during the movement of the top panel 102, a suitable adhesive is applied to either the outer pour spout portion 218 or the inner pour spout portion 232. As illustrated in FIG. 7, the movement of the top panel 102 is continued until the inner pour spout portion 218 is superposed over and in contact with the outer pour spout portion 218. When the adhesive has secured the outer and inner pour spout portions 218 and 232 together, the top panel 102 is folded back over the fold line 126. A conventional stop (not shown) will prevent movement of the inner pour spout portion 232 so that the movement of the top panel 102 will break the perforations in the perforated line 234 to separate the inner pour spout portion 232 from the top panel 102 as illustrated in FIG. 8. The inner pour spout portion 232 has a configuration slightly larger than the configuration of the outer pour spout portion 218 so as to have an interference fit in the first opening 210. A filled carton is formed in the same manner as described above in relation to FIGS. 3–5.

When it is desired to remove some of the material in the carton, a force is applied to the tab 228 to break the perforated lines 216, 224 and 226 and move the tab 228 inwardly around the fold line 230. An outwardly directed force is applied to the outer and inner pour spout portions 218 and 232 to break the perforations in the perforated lines 212 and 214 and fold the outer and inner pour spout portions 218 and 232 around the fold line 220. As the outer and inner pour spout portions 218 and 232 move outwardly, the tabs 236 and 240 are folded around the fold lines 238 and 242 and move through the first opening 210. After the desired quantity of material has been removed from the carton, the tab 228 is returned to its original location. An inwardly directed force is applied to the outer and inner pour spout portions 218 and 232 until the inner pour spout portion 232 fills the first opening 210. The tabs 236 and 240 function to limit the movement of the outer and inner pour spout portions 218 and 232 to the desired location.

Another preferred embodiment of the invention is illustrated in FIGS. 11–15. The portions of FIGS. 11–15 that correspond to portions of FIGS. 2–5 have been given the same reference numerals.

The glue panel 250 has a first portion 252 having a width similar to that of the sidewall panels 122 and 134 and a second portion 254 having a width similar to the glue panel 118. If desired, the glue panel 250 can be completely similar to the sidewall panels 122 and 134. The first portion 252 has an opening 256. If desired, the opening 256 can be defined by a series of perforations which, when broken, forms the opening 256.

A cut out portion 260 is made in the sidewall panel 134. A series of perforations 262, 264 and 266 in the sidewall panel 134 define a slide member 268 and a pull tab 270. The slide member 268 and the pull tab 270 are connected by a fold line 272. The distance between the perforations 262 and 266 adjacent to the perforations 264 is less than the distance between the perforations 262 and 266 adjacent to the fold line 272. An intermediate panel 274 is connected to the top wall panel 106 by perforations 276.

Figure 11:
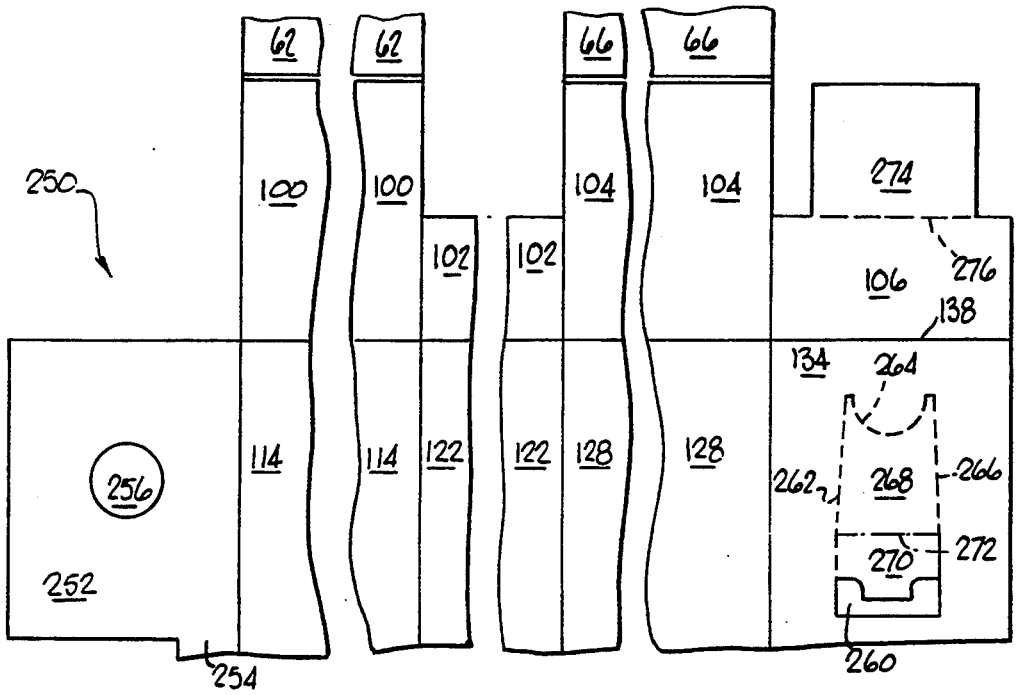
FIG. 11 is a top plan view of another preferred embodiment of a carton blank of this invention and a portion of the preceding carton blank.
Figure 12:
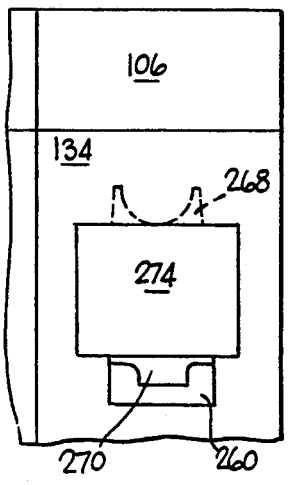
FIG. 12 is a top plan view of a portion of FIG. 11 after two folding operations.
Figure 13:
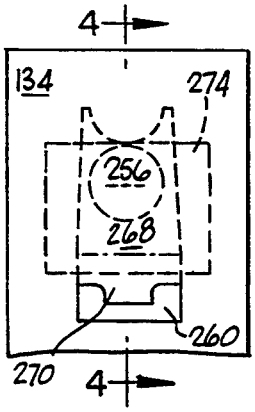
FIG. 13 is a side elevational view of a portion of a carton formed from the carton blank of FIG. 11.
Figure 14:
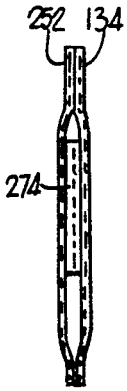
FIG. 14 is a cross-sectional view taken on the line 14—14 of FIG. 13.
Figure 15:
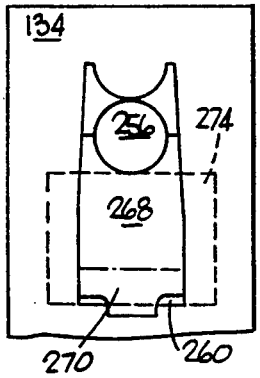
FIG. 15 is a side elevational view similar to FIG. 13 but with the pour spout open.

In forming a carton from the carton blank of FIG. 11, the top panel 106 is folded around the fold line 138 until the intermediate panel 274 is superposed over the slide member 268 and is secured thereto. The top panel 106 is returned to its original position and the perforations 276 are broken during the return movement leaving the intermediate panel 274 secured to the slide member 268. As illustrated in FIG. 12, the intermediate panel 274 has a width that is greater than the width of the slide member 268. The front and back wall panels 114 and 128, the glue panel 250 and the sidewall panels 122 and 134 are folded around the fold lines therebetween and the glue panel 250 is secured to the sidewall panel 134 to hold them in the folded relationship. The glue panel 250 is secured to the sidewall panel 134 but not to the intermediate panel 274, the slide member 268 and the pull tab 270 so that the intermediate panel 274, the slide member 268 and the pull tab 270 are free to have sliding movement relative to the glue panel 250 and the sidewall panel 134. The bottom wall panels are secured together and the carton is filled with desired ingredients. The top wall panels are then secured together to form a closed filled carton.

When it is desired to remove some of the ingredients from the carton, an outwardly directed force is applied to the pull tab 270. A downwardly directed force is applied to the pull tab 270 to break the perforations 262, 264 and 266 to allow the slide member 268 and the intermediate panel 274 to move downward from the location illustrated in FIGS. 13 and 14 to the location in FIG. 15 so that ingredients may be removed by passing through the opening 256. The opening 256 is closed by moving the slide member 268 and the intermediate panel 274 upwardly.

Another preferred embodiment of the invention is illustrated in FIGS. 16–20. The portions of FIGS. 16–20 that correspond to portions of FIGS. 2–5 and 11–15 have been given the same reference numerals.

Figure 16:
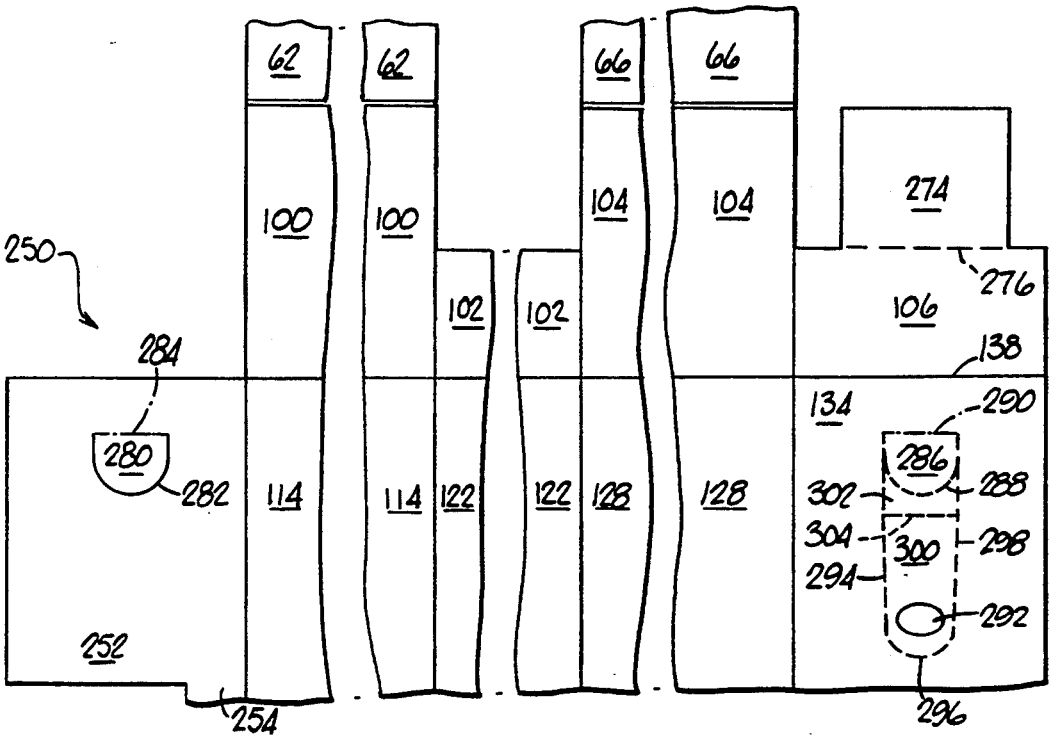
FIG. 16 is a top plan view of another preferred embodiment of a carton blank of this invention and a portion of the preceding carton blank.

A tab 280 for forming an opening in the glue panel 250, illustrated in the closed position in FIG. 16, is defined by the perforations 282 and a fold line 284. Another tab 286 for forming an opening in the sidewall panel 134, illustrated in the closed position in FIG. 16, is defined by the perforations 288 and the fold line 290. A cut out portion 292 is made in the sidewall panel 134. A series of perforations 294, 296 and 298 define a slide member 300 and a pull tab 302. The pull tab 302 and the slide member 300 are joined by a fold line 304. The distance between the series of perforations 294 and 298 adjacent the cut out portion 292 is less than the distance between the series of perforations 294 and 298 adjacent the fold line 304. An intermediate panel 274 is connected to the top wall panel 106 by perforations 276.

Figure 17:
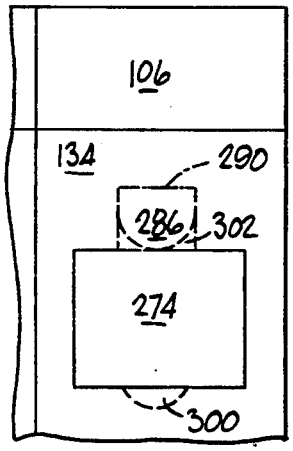
FIG. 17 is a top plan view of a portion of FIG. 16 after two folding operations.
Figure 18:
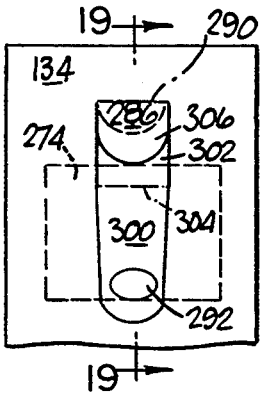
FIG. 18 is a side elevational view of a portion of a carton formed from the carton blank of FIG. 16.
Figure 19:
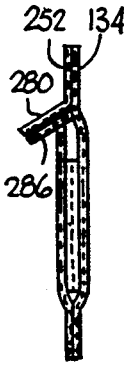
FIG. 19 is a cross-sectional view taken on the line 19—19 of FIG. 18.
Figure 20:
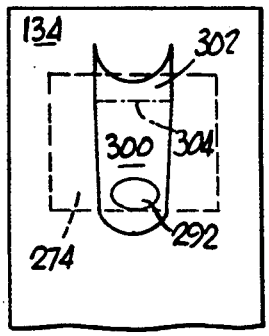
FIG. 20 is a side elevational view similar to FIG. 18 but with the pour spout closed.

In forming a carton from the carton blank illustrated in FIG. 16, the top wall panel 106 is folded around the fold line 138 until the intermediate panel 274 is superposed over the slide member 300 and is secured thereto. The top wall panel 106 is returned to its original position and the perforations 276 are broken during the return movement leaving the intermediate panel 274 secured to the slide member 300. As illustrated in FIG. 17, the intermediate panel 274 has a width that is greater than the width of the slide member 300. The front and back wall panels 114 and 128, the glue panel 250, the sidewall panels 122 and 134 are folded around the fold lines therebetween and the glue panel 250 is secured to the sidewall panel 134 to hold them in the folded relationship. The glue panel 250 is secured to the sidewall panel 134 but not to the intermediate panel 274, the slide member 300 and the pull tab 302 so that the intermediate panel 274, the slide member 300 and the pull tab 302 are free to have sliding movement relative to the glue panel 250 and with the sidewall panel 134. The bottom wall panels are secured together and the carton is filled with desired ingredients. The top wall panels are then secured together to form a closed filled carton. As illustrated in FIG. 19, the tabs 280 and 286 are in a superposed relationship.

When it is desired to remove some of the ingredients from the carton, an inwardly directed force is applied to the tabs 280 and 286 to sever the perforations 282 and 288 to form an opening 306 in the carton so that ingredients may be removed. To close the opening in the carton, an outwardly directed force is applied to the pull tab 302. An upwardly directed force is then applied to the slide member 300 to break the perforations 294, 296 and 298 to permit the slide member 300 and the intermediate panel 274 to move upwardly and close the opening 306 in the carton. If desired, the upwardly directed force may be applied by inserting the end of a finger into the cut out portion 292.

Figure 21:
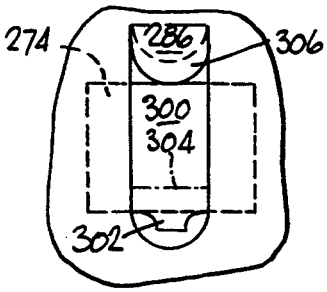
FIG. 21 is a side elevational view of a portion of another preferred embodiment of the invention.

Another preferred embodiment of the invention is illustrated in FIG. 21. This differs from the illustration in FIG. 18 only in that the pull tab 302 is located at the bottom of the slide member 300.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A carton formed from a one piece carton blank and said carton having a pour spout comprising:

a front wall panel, a back wall panel, opposite sidewall panels, a plurality of top wall panels, a plurality of bottom wall panel, and a glue panel folded and secured to form a carton;

pour spout means in one of said panels for permitting removal of materials inside of the carton comprising:

an inner panel having a series of perforations so that an opening may be formed therein;

an outer panel having at least a series of perforations;

a slide member located within said at least a series of perforations so that said slide member can have linear sliding movement when said at least a series of perforations have been broken so that said slide member can be moved between locations to expose or cover said opening in said inner panel; and an intermediate panel secured to at least a portion of said slide member and mounted for linear sliding movement therewith.

2. A carton as in claim 1 and further comprising:

said carton having a top end and a bottom end;

said at least a series of perforations in said outer panel having opposite portions extending generally in linear directions and each having a top end and a bottom end; and the distance between said top ends being less than the distance between said bottom ends.

3. A carton formed from a one piece carton blank and said carton having a pour spout comprising:

a front wall panel, a back wall panel, opposite sidewall panels, a plurality of top wall panels, a plurality of bottom wall panels, and a glue panel folded and secured to form a carton:

pour spot means in one of said panels for permitting removal of materials inside of the carton;

an inner panel having a series of perforations for forming an opening therein;

an outer panel having a first series of perforations formed therein for forming an opening therein in superposed relationship with said series of perforations in said inner panel and also having a second series of perforations; and a slide member located within said second series of perforations in said outer panel so that said slide member can have linear sliding movement when all of said second series of perforations have been broken so that said slide member can be moved between locations to expose or cover said superposed openings in said inner and outer panels formed by breaking the series of perforations in said inner panel and said first series of perforations.

4. A carton as in claim 3 and further comprising:

an intermediate panel secured to at least a portion of said slide member and mounted for linear sliding movement therewith.

5. A carton as in claim 4 and further comprising:

said carton having a top end and a bottom end;

said series of perforations in said outer panel having opposite portions extending generally in linear directions and each having a top end and a bottom end; and the distance between said bottom ends being less than the distance between said top ends.

6. A carton blank comprising:

a unitary sheet of material having an inner surface and an outer surface;

said unitary sheet of material having a left side edge, a right side edge, a top edge and a bottom edge, said left and right side edges being perpendicular to said top and bottom edges;

said unitary sheet of material having cut and fold lines for dividing said unitary sheet of material into front and back wall panels, opposite sidewall panels, a glue panel and top and bottom wall panels extending from said front and back wall panels and said opposite sidewall panels and joined thereto by fold lines and an intermediate panel joined to one of said top wall panels by a perforated line so that said intermediate panel may be separated from said one of said top wall panels;

said glue panel having an opening formed therein;

perforations in at least one of said opposite sidewall panels for forming a slide member when said perforations are broken to form a portion of pour spot means in a carton formed from said carton blank; and said pour spot means comprising said opening in said glue panel, said slide member and said intermediate member secured to said slide member for movement therewith.

7. A carton blank as in claim 6 wherein:

said cut and fold lines divide said unitary sheet of material into a front wall panel, a first sidewall panel integral with said front wall panel and joined thereto by a fold line, a back wall panel integral with said first sidewall panel and joined thereto by a fold line, a second sidewall panel integral with said back wall panel and joined thereto by a fold line and top and bottom wall panels extending outwardly from said front wall panel, said first sidewall panel, said back wall panel and said second sidewall panel and joined thereto by fold lines;

said first sidewall panel having a series of perforations for defining a first opening;

an outer pour spout portion located within said perforations and having a portion thereof integral with said first sidewall panel and joined thereto by a fold line; and said another panel comprising an inner pour spout portion so that said one of said top wall panels may be folded around its fold line so that said inner pour spout portion may be superposed over and secured to said outer pour spout portion and said one of said top panel portions may be returned to its original position with said inner pour spout portion remaining secured to said outer pour spout portion.

8. A carton blank as in claim 7 and further comprising:

a pair of spaced apart side panels integral with said inner pour spout portion and joined thereto by fold lines.

9. A carton blank as in claim 8 and further comprising:

said first sidewall panel having another series of perforations for defining a second opening; and a tab located within said another series of perforations and having a portion thereof integral with said first sidewall panel and joined thereto by a fold line so that an inwardly directed force may be applied to said tab to move said tab inwardly so that an outwardly directed force may be applied to said outer and inner pour spout portions to move said outer and inner pour spout portions outwardly and to move said side panels outwardly to form a pour spout.

10. A carton blank as in claim 7 wherein:

said inner pour spout portion having a configuration slightly larger than the configuration of said outer pour spout portion so as to have an interference fit in said opening in said outer panel; and a pair of spaced apart tabs integral with said inner pour spout portion and joined thereto by fold lines so that, when an outwardly directed force is applied to said inner and outer pour spout portion to move said inner and outer pour spout portions outwardly, said tabs will move outwardly and fold around said fold lines and when a force is applied to move said inner and outer pour spout portions inwardly, said tabs will abut against portions of said first sidewall panel to limit the inward movement of said inner and outer pour spout portions.

11. A carton blank comprising:

a unitary sheet of material having an inner surface and an outer surface;

said unitary sheet of material having a left side edge, a right side edge, a top edge and a bottom edge, said left and right side edges being perpendicular to said top and bottom edges;

said unitary sheet of material having cut and fold lines for dividing said unitary sheet of material into front and back wall panels, opposite sidewall panels, a glue panel and top and bottom wall panels extending from said front and back wall panels and said opposite sidewall panels;

said glue panel having an opening formed therein to form an inner portion of pour spot means in a carton formed from said carton blank;

perforations in at least one of said opposite sidewall panels for forming an outer portion of said pour spot means; and another panel secured to one of said top wall panels for forming an intermediate portion of said pour spot means.

12. A carton formed from a one piece carton blank and having a pour spout comprising:

a front wall panel, a back wall panel, opposite sidewall panels, a plurality of top wall panels, a plurality of bottom wall panels and a glue panel folded and secured to form a carton;

pour spout means for permitting removal of materials inside of said carton comprising:

at least one of said opposite sidewall panels superposed and secured to at least a portion of said glue tab panel;

said at least a portion of said glue tab panel having an opening formed therein;

said at least one of said opposite sidewall panels having at least a series of perforations formed therein;

a slide member located within said at least a series of perforations so that said slide member can have linear sliding movement relative to said at least one of said opposite sidewall panels when said at least a series of perforations have been broken so that said slide member can be moved between locations to expose or cover said opening in said portion of said glue tab panel;

an intermediate panel secured to at least a portion of said slide member and mounted for linear sliding movement therewith.

13. A carton as in claim 12 and further comprising:

said carton having a top end and a bottom end;

said at least a series of perforations in said outer panel having opposite portions extending generally in linear directions and each having a top end and a bottom end; and the distance between said top ends being less than the distance between said bottom ends.

14. A carton as in claim 12 and further comprising:

at least one of said top wall panels joined to said at least one of said opposite sidewall panels by a fold line; and said intermediate panel comprising a separate panel detachably secured to said at least one of said top wall panels.

* * * * *